US008020668B2

(12) United States Patent
Hsu et al.

(10) Patent No.: US 8,020,668 B2
(45) Date of Patent: Sep. 20, 2011

(54) OPERATING LESS THAN ALL OF MULTIPLE CARS IN A HOISTWAY FOLLOWING COMMUNICATION FAILURE BETWEEN SOME OR ALL CARS

(75) Inventors: Arthur C. Hsu, South Glastonbury, CT (US); Theresa M. Christy, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 496 days.

(21) Appl. No.: 12/303,289

(22) PCT Filed: Jun. 7, 2006

(86) PCT No.: PCT/US2006/022797

§ 371 (c)(1),
(2), (4) Date: Dec. 3, 2008

(87) PCT Pub. No.: WO2007/142653

PCT Pub. Date: Dec. 13, 2007

(65) Prior Publication Data

US 2009/0223747 A1 Sep. 10, 2009

(51) Int. Cl.
*B66B 9/00* (2006.01)

(52) U.S. Cl. ..... 187/249; 187/247; 187/391

(58) Field of Classification Search ..... 187/247, 187/248, 249, 380–388, 391–393
See application file for complete search history.

(56) References Cited

U.S. PATENT DOCUMENTS

| | | | | |
|---|---|---|---|---|
| 5,387,769 | A * | 2/1995 | Kupersmith et al. | 187/248 |
| 5,654,531 | A * | 8/1997 | Farabee et al. | 187/247 |
| 5,663,538 | A * | 9/1997 | Sakita | 187/382 |
| 5,865,274 | A | 2/1999 | Kiji et al. | |
| 5,877,462 | A * | 3/1999 | Chenais | 187/249 |
| 6,173,814 | B1 * | 1/2001 | Herkel et al. | 187/288 |
| 6,273,217 | B1 | 8/2001 | Hikita | |
| 6,871,727 | B2 | 3/2005 | Jokela et al. | |
| 7,213,685 | B2 * | 5/2007 | Hikita | 187/249 |
| 7,353,912 | B2 * | 4/2008 | Reuter et al. | 187/249 |
| 7,392,883 | B2 * | 7/2008 | Hikita | 187/249 |

OTHER PUBLICATIONS

International Search Report and Written Opinion of the International Searching Authority for International Application No. PCT/US06/22797 mailed Dec. 27, 2006.

* cited by examiner

*Primary Examiner* — Anthony Salata
(74) *Attorney, Agent, or Firm* — Carlson, Gaskey & Olds PC

(57) ABSTRACT

A plurality of cars (A-C) traveling in the same hoistway (10) send communication check codes (27, 35, 70, 77) to each other over a first communication channel, and if a response is not received (30, 37, 73, 80) within a predetermined time (32, 38, 74, 81) the car not getting a response will send a failure mode command to the other two cars (53, 82). Either the car (A) which senses the failure, or a predesignated car (B) will assume a wild car mode (60, 88) after the other two cars are safely parked (56, 57; 85, 86) out of the way, under control of special sensors and signals sent over a second communications channel. Two out of three cars may operate if only one has communication failure with one or two of the others.

10 Claims, 5 Drawing Sheets

10
14
11
16
CTRLR
17
12
A
B
C
52
13

10
14
16
CTRLR
17
12
11
A
B
C
13

10
14
16
CTRLR
17
12
11
11a
A
B
C
13

10
11b
16
CTRLR
17
12
11
A
B
C
13

OPERATING LESS THAN ALL OF MULTIPLE CARS IN A HOISTWAY FOLLOWING COMMUNICATION FAILURE BETWEEN SOME OR ALL CARS

TECHNICAL FIELD

This invention relates to causing less than all of a plurality of cars in a given hoistway to provide service to passengers from that hoistway, following a breakdown in communications between one car and one or more other cars operating in said given hoistway.

BACKGROUND ART

A recent innovation in elevator technology is to save space utilized for elevator hoistways, instead of for rental or other beneficial use, by having two or more elevators operating within the same hoistway. In order to maximize the benefit derived therefrom, the elevators must move as freely as possible while maintaining suitable separation. In order for this to occur, there must be communications of operational data, either directly between the several elevators in the single hoistway, or between each of them and a central controller. Due to the amount of data, and the frequency with which it has to be updated, hard wiring each of the cars to the other, or to a common controller, will not effectively communicate the required operational data. Therefore, communication networks such as Ethernet or CAN are used in a typical case. However, communications of this sort are subject to failure, due to hardware breakdown or disconnection, disruption to power supply, noise or otherwise.

DISCLOSURE OF INVENTION

Objects of the invention include: maximizing freedom of operation between the plurality of cars in a single hoistway; avoiding the possibility of contact between elevator cars in a single hoistway due to failure of communication; improved multi-car-per-hoistway elevator systems; and back-up operations in a multi-car hoistway following communication failure between at least some of the cars.

According to the present invention, each car serving in a single hoistway with one or more other cars shares large amounts of operational information with other cars over a primary communications channel, and causes communication checks over the primary communications channel, either with the other cars, or with a common controller, and in the event of its sensing a failure of communications, service within that hoistway is caused to be provided by less than all of the plurality of cars in the hoistway.

According to one form of the invention, an elevator that is designated to provide exclusive service will stop in response to an indication of the communication failure, and will not move until each other car normally operating within the hoistway is parked in a designated area, to permit the exclusively-operating car to travel throughout the entire hoistway, or at least between a majority of the floors thereof.

In one embodiment of the invention, the elevator car that first declares a communication failure is the one that is designated to provide the exclusive service. In accordance with another embodiment of the invention, one of the several cars may be pre-designated to always be the car that will perform exclusive service.

The invention may be practiced by allowing two cars of a three-car hoistway to operate if they have primary communications between them. Similarly, other numbers of cars may operate with less than all of the other cars (such as two out of three).

One of the designated areas in which an elevator that is not to perform exclusive service is to be parked, is below the first floor of the building; or one of the elevator cars may be parked in a space above the highest floor of the building, before allowing another car to perform exclusive service. If there is an upper parking area, and there are more than two cars in a hoistway, the uppermost car may be parked on the uppermost floor, the remaining service being operable only between the first floor and the next to highest floor. If more than three cars are serving a single hoistway, and upper and lower parking areas for only two cars, one of the cars may be parked at the first floor or the highest floor, so that the car which remains in service serves less than the total number of floors. Extensions of this analysis can be applied to implement the present invention in a variety of circumstances. If cars can move horizontally, run-by areas next to a hoistway may be used to park cars.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
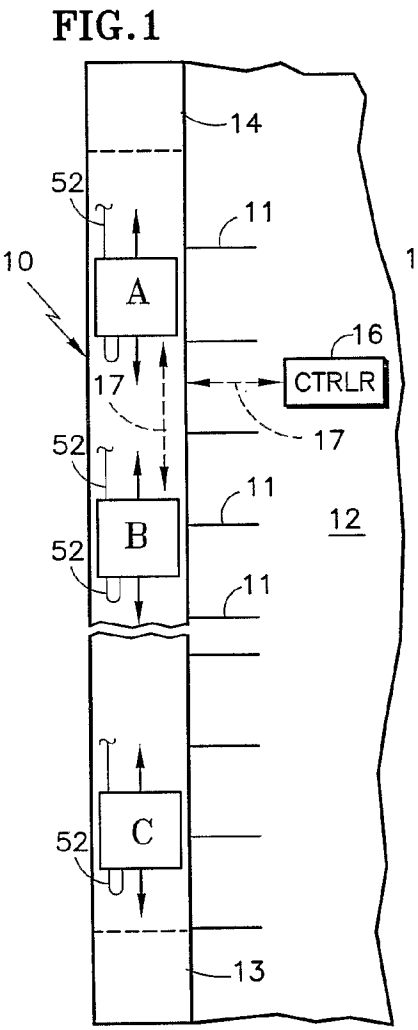
FIG. 1 is a side elevation diagrammatic illustration of a single hoistway having three cars servicing passengers therein.

Referring to FIG. 1, a hoistway 10 serving a plurality of floors 11 of a building 12 includes a lower parking area 13 and an upper parking area 14. Within the shaft 10, three elevators A, B, C are moving upwardly and downwardly to provide service to passengers between the first and top floors 11 of the building 12.

In accordance with one embodiment of the invention, the middle car, B, is always selected to provide exclusive service in the event of failure of a first communication channel 17, either between the cars themselves or between the cars and a common controller 16, that assures separation of the cars, As shown, car A is always parked in the upper area 14 and car C is always parked in the lower area 13.

Figure 2:
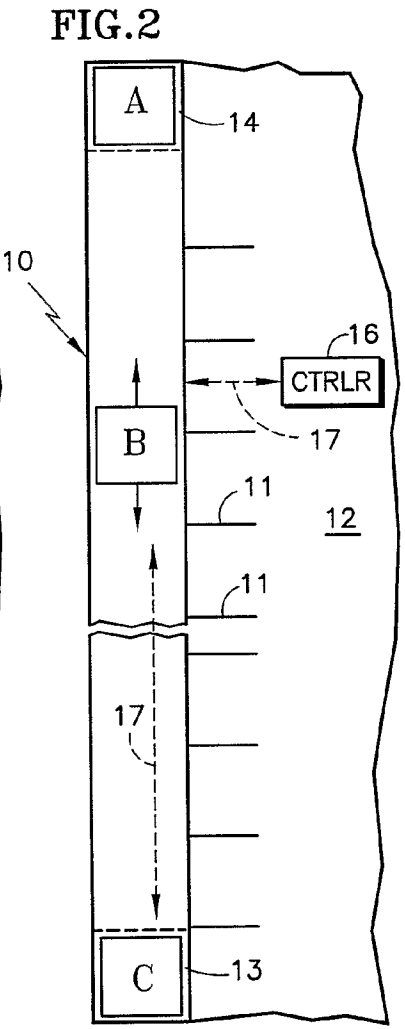
FIG. 2 is a side elevation diagrammatic illustration of an elevator hoistway in which the uppermost car and the lowermost car are parked in the upper and lower areas, respectively, so that the remaining car can service all the floors of the building without interference by the other cars.
Figure 3:
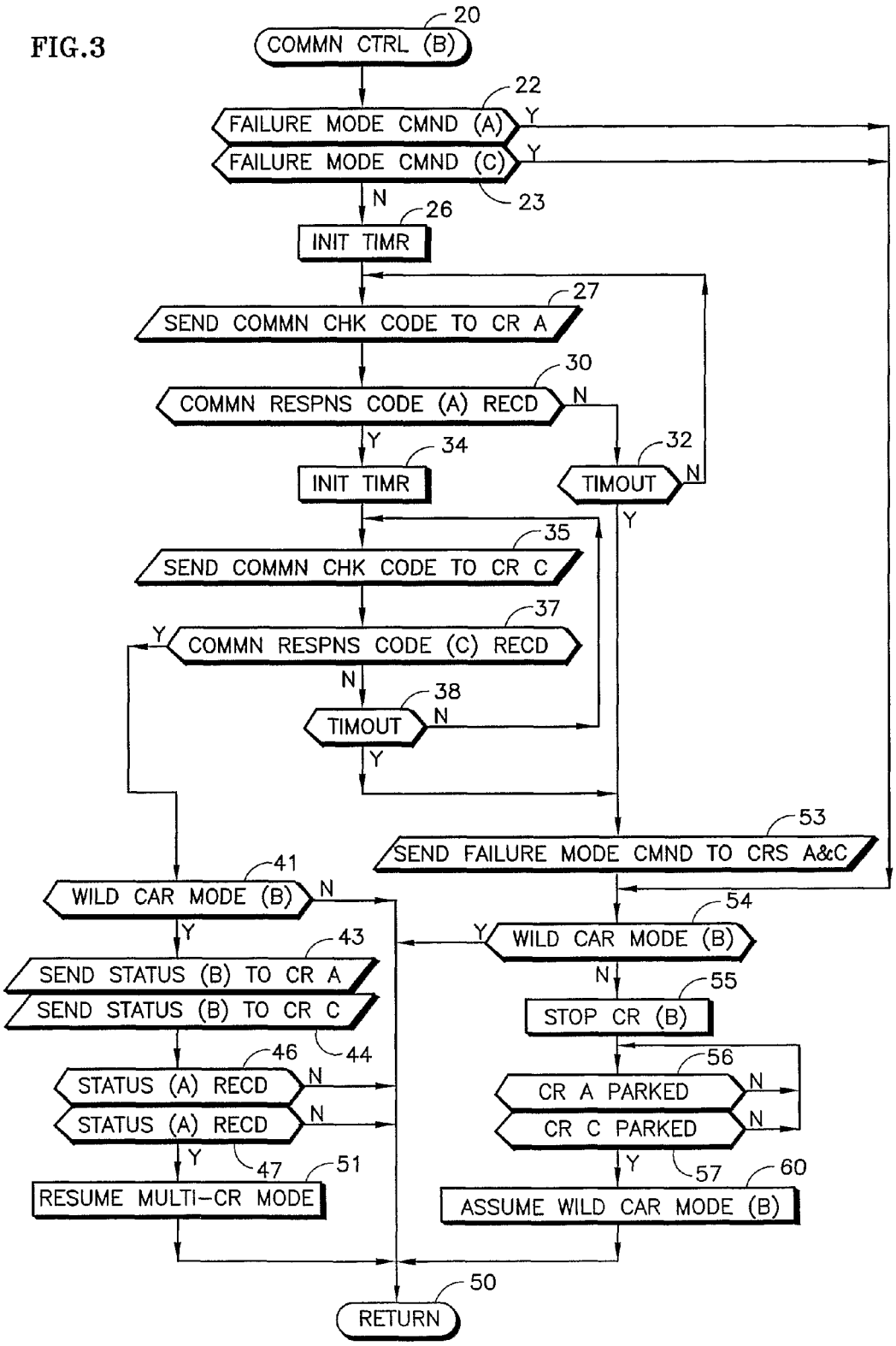
FIG. 3 is a diagrammatic illustration of functions which may be performed in implementing a first embodiment of the invention illustrated in FIG. 2.

The embodiment of FIGS. 2 and 3 includes routines in a controller of car B with reference to communication control of car B, which may be reached such as at a routine entry point 20. In this embodiment, each car always first checks to see if some other car has indicated a failure mode command, such as at the tests 22 and 23 which represent failure mode commands from car A and car C, respectively. If so, car B does not check for a failure; if not, then car B will determine if there is a communication failure.

Car B initiates a timer in a step 26 and sends a communication check code to car A by means of a subroutine 27. A test 30 awaits a communication response code from car A. If none is forthcoming, a test 32 determines if the timer has timed out or not. If not, the subroutine 27 and test 30 are repeated. If a communication response code is received from car A, then car B will again initiate the timer in a step 34 and send a communication check code to car C by means of a subroutine 35. The controller of car B then awaits a communication response code transmitted from car C in a test 37. If none is forthcoming, then a test 38 determines if the timer has timed out; if not, the subroutine 35 and test 37 are repeated.

If a response has been received from both car A and car C, an affirmative result of test 37 reaches a test 41 to determine if car B is already in a wild car mode. If it is, then subroutines 43 and 44 will cause the status of car B to be sent to cars A and C, after which a reply is required in order to satisfy a pair of tests 46, 47. If either reply is not received, then a negative result of either test 46 or 47 will cause the routine to end and the program to return to other routines through a point 50. If a proper response is received from both cars A and C, then a step 51 will cause car B to resume the multi car mode of operation.

If both car A and car C respond to the communication check, as indicated by an affirmative result of test 37, and test 41 indicates that car B is not then in the wild car mode, then the routine ends, and the car B controller reverts to other programming through the point 50.

If either car fails to respond to car B's communication check, as indicated by the time out of test 32 or test 38, then a subroutine 53 will send a failure mode command to the other cars over a second communications channel. In such case, or if either car has commanded a failure mode as indicated by one of the tests 22, 23, a test 54 will determine if car B is already in wild car mode. If so, the program reverts through point 50. If not, a step 55 will cause car B to stop and tests 56 and 57 determine when both cars are properly parked. Additional subroutine steps may be provided so that an alarm will sound if both of tests 56 and 57 are not affirmative within a particular time frame. If both tests are successful, a step 60 will cause car B to assume the wild car mode of operation.

In order for proper operation of the invention, the manner in which failure mode commands are sent from one car to another (or between each car, a common controller 16 and other cars) may be an essentially-foolproof communication channel 52, such as a hard wire within the traveling cable of each car and hard wire connections to the other cars' traveling cables, either directly or through a common controller (shown only in FIG. 1 for clarity). Or, the backup channel could use the same type of network as the primary channel (e.g., Ethernet), as long as the failure modes are independent, so that it still functions when the primary channel fails. For example, a typical failure mode for wireless communications is failure of battery power; failure of batteries for primary communications at the same time as failure of batteries for the secondary communications is rare; these failure modes are thus independent.

To determine that cars are parked, there must be a sensor which is unique to the presence of a car, preferably with some sort of time duration detection to assure the car is fully parked, which may comprise additional switches at the lower and upper areas, or at the first floor, the top floor or wherever cars are to be parked when leaving the all-car operational mode. Such switches in turn must have an independent communications channel to the other cars that typically does not fail even if the primary communications channel fails.

Figure 4:
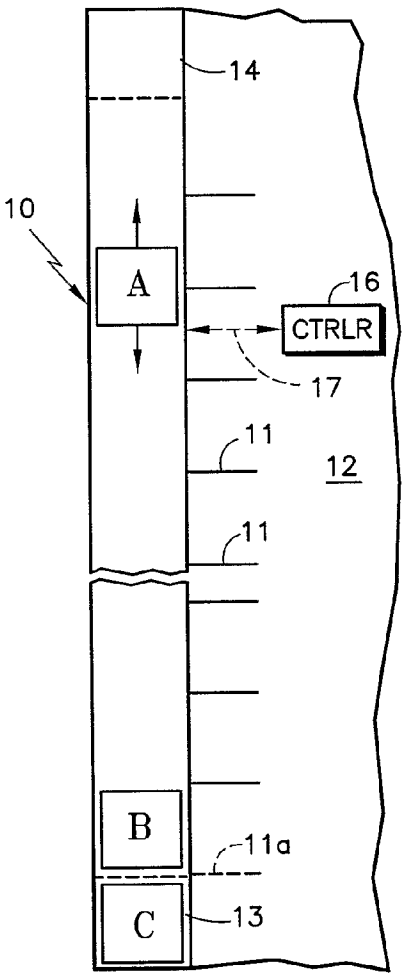
FIG. 4 is a side elevation diagrammatic illustration of three cars serving an elevator hoistway, with one car parked in the lower area, one car parked at the first floor, and a third car serving the second through top floors of the building.

Referring to FIG. 4, a second embodiment of the invention does not always use the middle of three cars to provide exclusive service in the wild car mode, regardless of which car senses failure. Instead, the first car to sense failure becomes the wild car. Therein, it is seen that car C is parked in the lower area, and car B is parked at the first floor 11*a*, taking it out of service, as is indicated by the dotted line. If horizontal movement of any of cars A-C is permitted, such cars may be parked alongside of the hoistway in run-by areas. Of course, where it is possible in any building, a lower parking area (below the first floor) may provide for two cars, one parked above the other, below the first floor so that service to the first floor is not lost. The same may be true for the upper parking area (that is, able to park cars one above the other).

Figure 5:
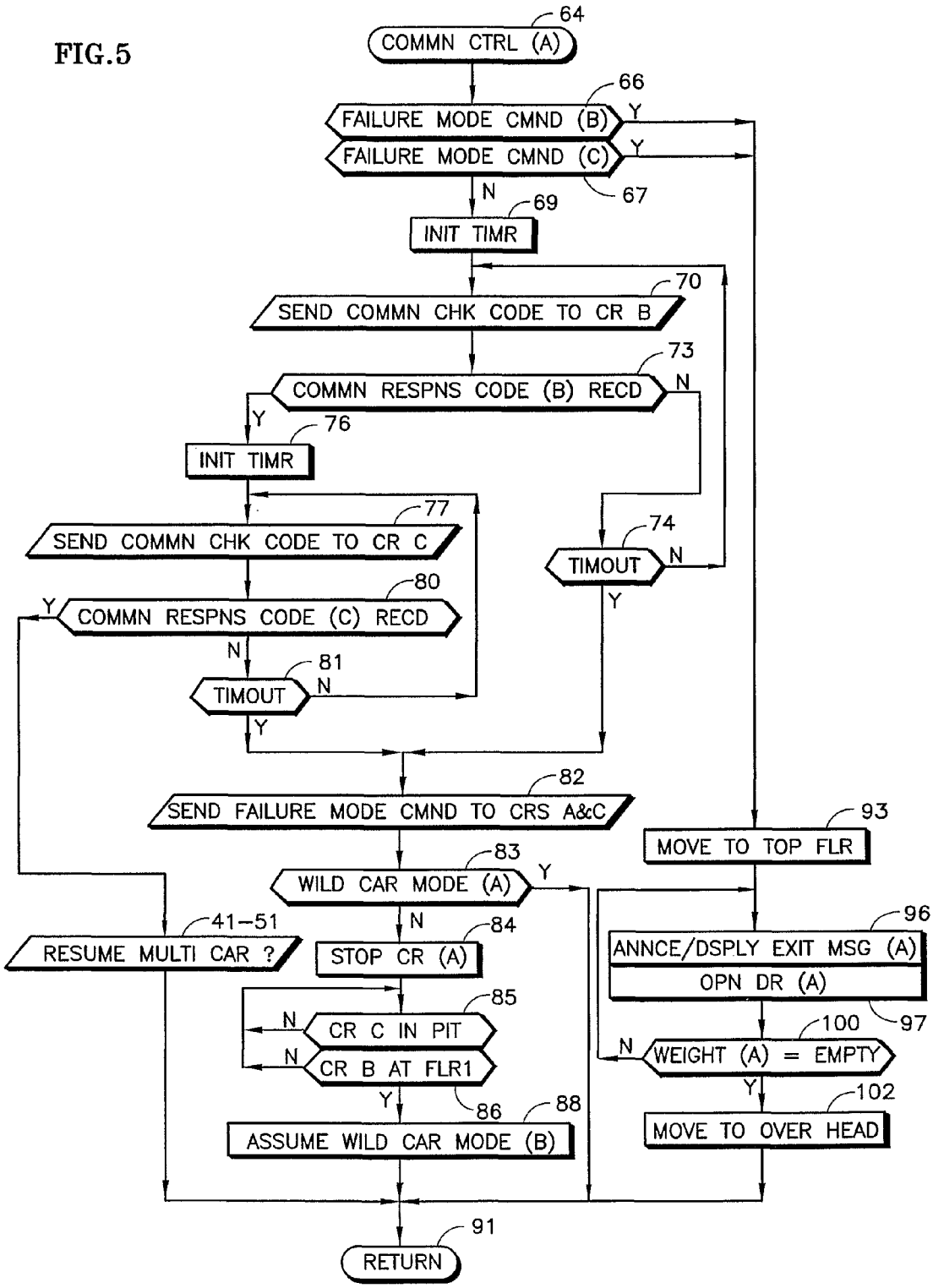
FIG. 5 is a diagrammatic illustration of functions which may be performed in implementing the present invention in a manner in which the first car to sense the communication failure will remain in operation, while the other two cars will remain parked, in the instance shown, the lower two cars are parked in the lower area and at the first floor, as illustrated in FIG. 4.

Car A is still able to travel up and down to serve passengers between the second floor and the top floor of the building. This may be effected by car's A controller as indicated in the routine of FIG. 5, reached through a point 64. A first pair of steps 66, 67 determine if either of the other cars has issued a failure mode command, as described with respect to FIG. 3. If so, then car C cannot become the wild car. If not, a step 69 and a subroutine 70 initiate a timer and send a communication check code to car B. A test 73 awaits the communication response code from car B, and a test 74 determines if the response is received before time out of the timer. If the response is properly received from car B, then communications with car C are checked in a step 76, a subroutine 77, and tests 80 and 81.

If either car B or car C does not respond in time, an affirmative result of test 74 or test 81 will reach a subroutine 82 which sends a failure mode command to cars B and C. A test 83 determines if car A is already in wild car mode; if so, the routine is exited at step 91. If not, a step 84 stops car A. Then tests 85 and 86 await notification in car A that car C is in the lower area and car B is parked at floor 1. When that occurs, a step 88 causes car B to assume the wild car mode of operation.

If neither car has sent the failure mode as indicated by negative results of tests 66 and 67, and both cars send communication response codes as indicated by affirmative results of tests 73 and 80, tests and steps similar to 41-51 in FIG. 3 handle the case of car C already being in the wild car mode. Then, the routine is ended and the controller reaches other programming through a return point 91. In the example described thus far with respect to FIG. 5, car A is the first car to note a failure in communications by the affirmative result of either test 74 or 81 and therefore car A becomes the wild car and continues to serve passengers.

In the event that either car B or car C is the first to declare a failure of communications, one of the tests 66, 67 will be affirmative reaching a step 93 commanding car A to move to the top floor. It is optional whether car A is allowed to answer hall calls after it is commanded to move to the top floor, if such calls are along its route. On the other hand, answering any calls may be prohibited; certainly, hall calls should not be answered.

A step 96 causes an exit message to be audibly announced and visually displayed, telling passengers that they must exit at this floor. The door is then opened at step 97 to allow passengers to exit. Then a test 100 determines if the car is empty, such as the load weight sensor detecting a weight indicative of there being no passengers in the car. Additional steps and tests may be employed to provide for a delay, and the announcement and display may be continued until a suitable weight is indicated by the load weighing system of the car. When it is determined with sufficient reliability that the car is empty, a step 102 will cause car A to move to the upper area and park.

In the routines relating to cars B and C, tests such as tests 85 and 86 in FIG. 5, will be performed to assure that not only is car A in the upper area, but the other car (B or C) is appropriately parked. Referring to FIG. 4, if car C is to perform the wild car mode, then car A will park in the upper area and car B must be parked at the top floor of the building, and it will have an appropriate sensor to determine when that is the case. Of course, more parking areas will avert parking on the first floor or the top floor.

Figure 6:
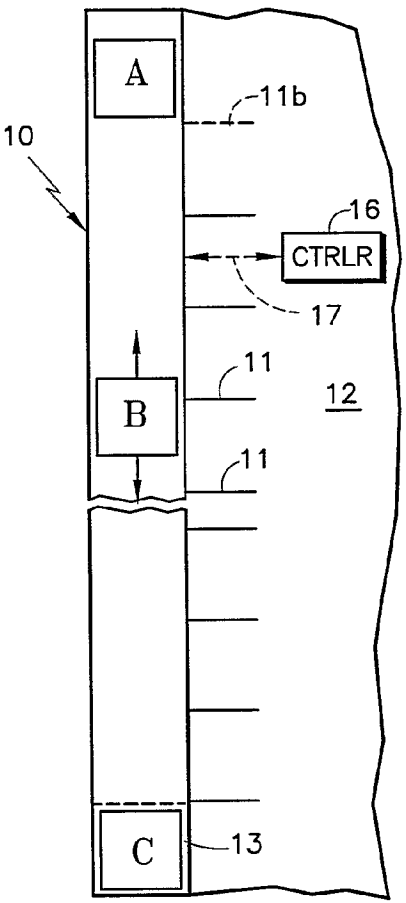
FIG. 6 is a side elevation diagrammatic illustration of an elevator hoistway in which the uppermost car is parked at the top floor.

As shown in FIG. 6, if there is no upper parking area, car A may be parked at the top floor 11*b*, as indicated by the dotted line.

The wild car mode may be simply answering calls to every other floor, answering any hall call which is entered, or whatever else is desired in any given implementation of the present invention.

Figure 7:
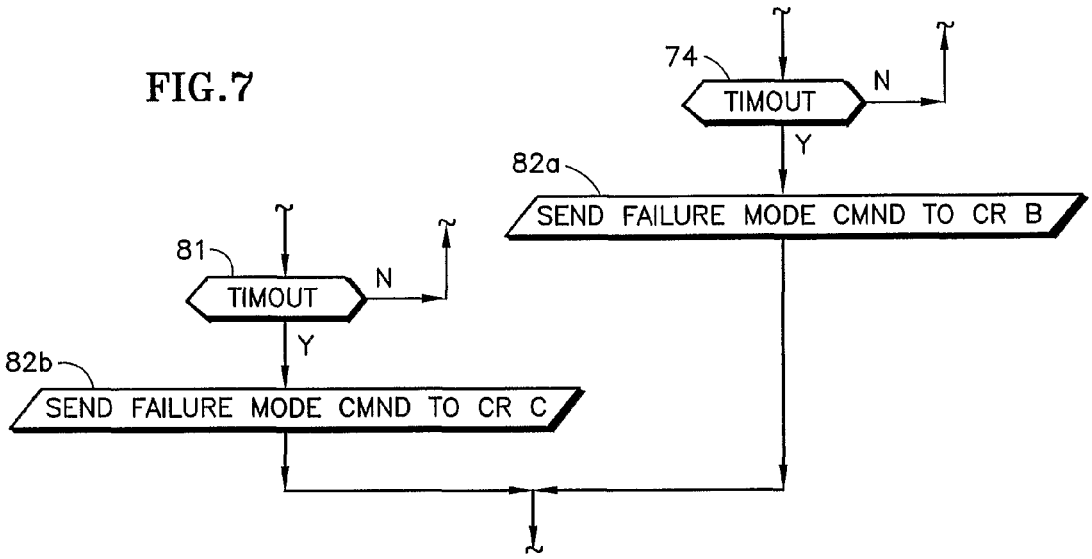
FIG. 7 is a partial modification to the functions illustrated in FIG. 5, sending failure mode commands separately to other cars.

The invention may be practiced with two of the three cars remaining operational if they retain primary communication. Referring to FIG. 7, an embodiment in which a pair of cars that do have proper communication may continue to operate, even if one car has failed communication with one other car, may be more easily implemented if the failure mode commands are sent separately to each car as illustrated by subroutines 82*a* and 82*b*, in contrast with sending a single failure mode command to all cars as illustrated in subroutine 82 of FIG. 3.

Figure 8:
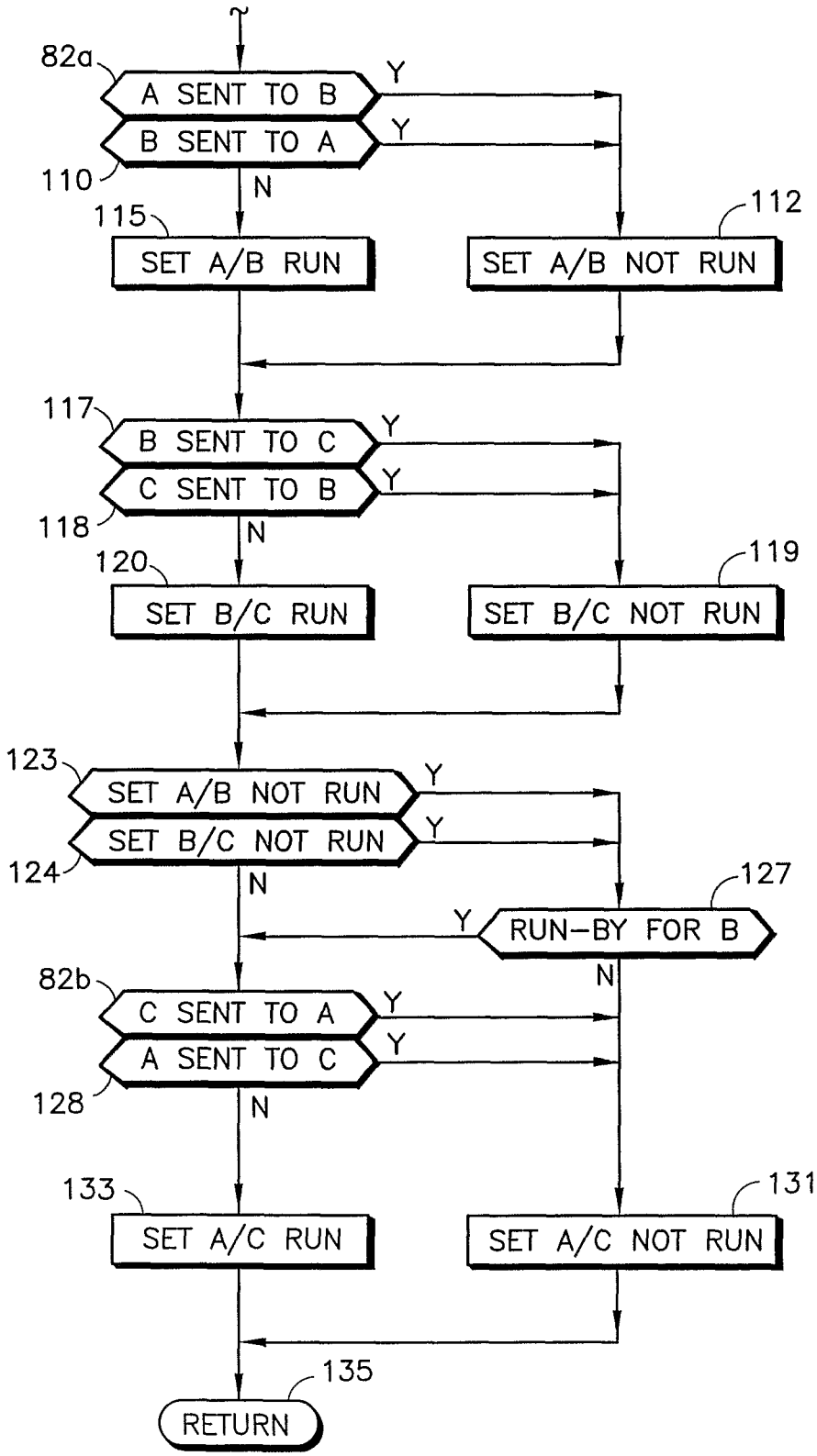
FIG. 8 is a diagrammatic illustration of logic which may determine with respect to each car, whether it has communications and is operable in the hoistway with respect to another car.

In FIG. 8, the nomenclature is shortened such that the subroutine 82*a* in FIG. 7 is indicated as send failure mode command to car B" or "A sent to B". Similarly, subroutine 82 *b* of FIG. 7 is illustrated (in the lower part of FIG. 8) as car C as sent a failure mode command to car B, shortened to "C SENT TO A". In FIG. 8, to further determine if cars A and B are properly communicating and can continue to run, a test 110 determines if car B sent a failure mode command to car A. If either test 82*a* or test 110 is affirmative, a step 112 will set an A/B NOT RUN flag indicating that cars A and B cannot remain operative together in the hoistway (although, as described hereinafter, it is possible that either car A or car B might continue to run with car C. If neither car A nor car B has sent a failure mode command to the other of them, negative results of tests 82*a* and 110 will reach a step 115 to set an A/B RUN flag indicating that cars A and B may run at the same time in the hoistway. In a similar fashion, tests 117 and 118 will determine whether a step 119 should set a B/C NOT RUN flag or step 120 should set a B/C RUN flag.

Because car B is between cars A and C, cars A and C cannot run together unless car B is running or it can be moved out of the way to an appropriate parking area. A test 123 determines if the A/B NOT RUN flag has been set in step 112 and a test 124 determines if the B/C NOT RUN flag has been set in step 119. If either of these flags have been set, then car B is not allowed to run. A test 127 determines if there is a run-by area to park car B out of the way; in the embodiments herein, such a parking area would require horizontal movement of car B out of the hoistway. If there is no way to remove car B from the hoistway, then cars A and C cannot run together in any event.

But if either car B has not been prohibited from running (tests 123 and 124 both negative) or it is able to park (test 127 positive), then the test 83*b* will determine if car C sent a failure mode command to car A and a test 128 will determine if car A sent a failure mode command to car C. If either of these have been sent, an affirmative result of test 82*b* or 128 will set the A/C NOT RUN flag in a step 131.

If car B is running (negative results of tests 123, 124) or has an appropriate run-by area (affirmative result of test 127) and neither car A nor car C has sent a failure mode command to the other, then a step 133 will set the A/C RUN flag so that car A and car C can both be running in the hoistway at the same time, with or without car B. Thereafter, other programming is reverted to through a return point 135.

In any embodiment where there are three cars in the hoistway, whenever there is a failure of communications in either direction between one car and another car, the center car (car B) must be stopped; if the center car is stopped, then the upper car may continue traveling upwardly (if that were the case) and the lower car may continue traveling downwardly (if that were the case), but they may not reverse direction. If the upper car is traveling downwardly, or if the lower car is traveling upwardly, then the respective car must be stopped whenever there is any communication failure.

As described with respect to the wild car mode of single car operation hereinbefore, steps must then be taken to ensure inoperative cars are out of the way before any cars that are permitted to continue may do so.

Figure 9:
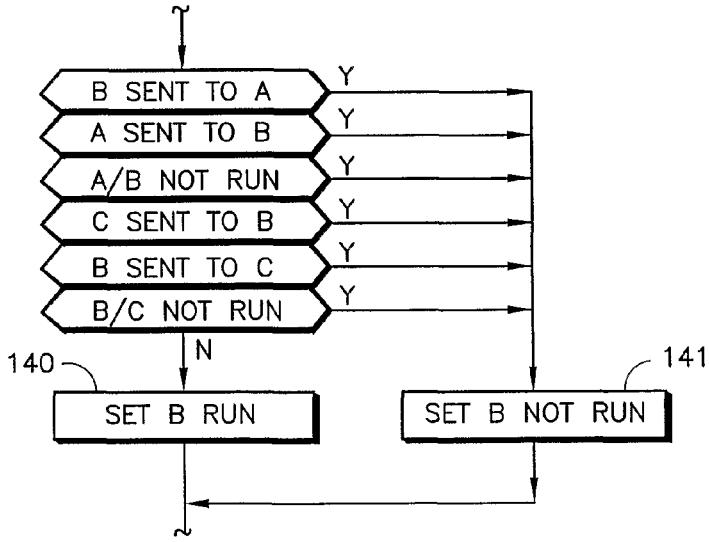
FIG. 9 is a diagrammatic illustration of logic within each car which may determine whether it is operable.

The functions are illustrated in FIG. 8 as if being performed by a common controller; however, to minimize communications relative to hoistway operation following a failure in the primary communication between any car and any other car, the steps 83*a* and 110-112 may be performed independently in car A and car B, with the "NOT RUN" flag being communicated over a secondary channel to inhibit the "RUN" flag which might be generated in the other car. This is illustrated with respect to car B in FIG. 9, which is evident from the inscription, and results in car B either being allowed to run or not regardless of whether it would be with car A or with car C. This is for the internal operation of car B.

In any embodiment of the invention, the primary feature is that there be a simple, possibly "ON/OFF", or binary indication of when a given car is properly parked, such as by means of a switch and either simple wiring, as described hereinbefore, or a secondary channel having failure modes different than the primary channel. Clearly, if a given car is parked, then that car need not and should not participate otherwise in the operation of other cars.

In the embodiment of FIGS. 6-9, in the event that communication failure is indicated to occur between more than one car and another car (i.e., all cars have "NOT RUN" flags set), then steps 85-88 of FIG. 3 (or suitable step of FIG. 5) may be utilized to cause one car to go into wild car mode, if desired.

The invention claimed is:

1. A method of controlling a plurality of elevator cars operating in a single hoistway servicing a plurality of floors in a building characterized by:

periodically transmitting from each one of said cars over a first communication channel, either directly or through a common controller, a communication check code to each other of said cars;

transmitting over said first communications channel, in response to receipt of said communication check code, from each of said other cars that receives said communication check code, to said one of said cars which has sent said communication check code, a communication response code;

determining, in a car which has sent a communication check code to one of said other cars, that a communication response code has not been received from said one of said other cars within a predetermined time;

sending a failure mode command over a second communications channel, from a car which has sent a communication check code but has not received a corresponding one of said communication response codes, to at least said one of said other cars;

moving said at least one of said other cars to a respective parking position out of the way of travel by at least another one of said cars between substantially all of said floors; and causing said at least another one of said cars to serve said substantially all of said floors.

2. A method according to claim 1 wherein:

said step of moving comprises moving all but one of said cars to a respective parking position out of the way of travel by another one of said cars; and said causing step comprises causing said one car to assume a wild car mode of serving said substantially all of said floors.

3. A method according to claim 2 wherein:

said causing step comprises causing the car which senses a failure of receipt of a communication response code from one of said other cars to assume said wild car mode.

4. A method according to claim 2 wherein:

said causing step comprises causing a predetermined car to assume the wild car mode.

5. A method according to claim 4 wherein:

said predetermined car is a car other than (i) the highest car operating in said hoistway or (ii) the lowest car operating in said hoistway.

6. A method according to claim 1 of controlling three cars operating in said hoistway.

7. A method according to claim 1 wherein said cars are parked (a) either (i) at or (ii) below the bottom floor of said building or (b) (iii) at or (iv) above the top floor of said building.

8. A method according to claim 1 wherein:

in a case where corresponding ones of said communication response codes have been not received from only a single one of said cars, said step of moving comprises moving said single one of said cars to a parking position out of the way of travel by others of said cars, and said step of causing comprises causing all of said cars but said single car to serve said substantially all of said floors.

9. A method according to claim 8 wherein:

there are three cars, and two out of three cars operate in said hoistway when one of said cars is parked.

10. A method according to claim 8 wherein:

two out of three cars may be allowed to operate at one time following a communication failure with one car.

* * * * *